US009327946B2

(12) United States Patent
Stakor et al.

(10) Patent No.: US 9,327,946 B2
(45) Date of Patent: May 3, 2016

(54) HYDRAULIC SIDE LOAD BRAKING SYSTEM

(75) Inventors: Gregory M. Stakor, Vinton, VA (US); William Baldwin Dodge, IV, Roanoke, VA (US)

(73) Assignee: Altec Industries, Inc., Birmingham, AL (US)

( * ) Notice: Subject to any disclaimer, the term of this patent is extended or adjusted under 35 U.S.C. 154(b) by 701 days.

(21) Appl. No.: 13/549,870

(22) Filed: Jul. 16, 2012

(65) Prior Publication Data

US 2014/0014609 A1 Jan. 16, 2014

(51) Int. Cl.
*E21B 7/02* (2006.01)
*B66C 13/18* (2006.01)
*B66C 23/84* (2006.01)

(52) U.S. Cl.
CPC ..... *B66C 13/18* (2013.01); *B66C 23/84* (2013.01)

(58) Field of Classification Search
CPC ..... B60P 1/5433; B66C 13/18; B66C 23/70; B66C 23/74; B66C 23/78; B66C 23/84; B66C 23/90; B66C 23/42; B66C 23/54; B66C 23/76; B66C 13/06; B66C 13/46; B66C 13/48; B66C 15/06; E02F 3/307; E02F 3/3604; E02F 3/3677; E02F 3/3681; E02F 3/384; E02F 9/123; E21B 7/026
USPC ..... 173/184
See application file for complete search history.

(56) References Cited

U.S. PATENT DOCUMENTS 3,572,514 A * 3/1971 Sauber ..... 212/270
3,586,841 A * 6/1971 Griffin ..... 702/43
3,612,294 A * 10/1971 Wilkinson ..... 212/278
3,645,407 A * 2/1972 Przybylski ..... B66C 23/90 212/278
3,690,387 A * 9/1972 Dixon ..... 173/193
3,713,129 A * 1/1973 Buchholz ..... 340/517
3,722,707 A * 3/1973 Hedeen et al. ..... 212/281
3,794,296 A * 2/1974 Hasstedt ..... B66C 23/48 212/300
3,871,528 A * 3/1975 Wilkinson ..... 212/278
3,919,816 A * 11/1975 Ranft ..... 52/116
4,003,474 A * 1/1977 Mooney ..... B66C 23/92 212/293
4,005,780 A * 2/1977 Morrow, Sr. ..... B66C 23/92 212/293
4,006,347 A * 2/1977 Hohmann ..... 701/124
4,027,772 A * 6/1977 Garber ..... 414/699
4,059,196 A * 11/1977 Uchino ..... E02F 9/2221 180/273
4,064,997 A * 12/1977 Holland et al. ..... 212/280
4,100,973 A 7/1978 Freudenthal
4,660,729 A * 4/1987 Carbert ..... 212/278
5,160,055 A * 11/1992 Gray ..... 212/278
5,160,056 A * 11/1992 Yoshimatsu et al. ..... 212/277
5,251,768 A * 10/1993 Yoshimatsu et al. ..... 212/277

(Continued)

FOREIGN PATENT DOCUMENTS

SU 492461 A 1/1974

*Primary Examiner* — Robert Long
(74) *Attorney, Agent, or Firm* — Erise IP, P.A.

(57) ABSTRACT

A boom system includes a boom turret, a brake for preventing rotational movement of the boom turret, and a controller for actuating the brake. The brake prevents movement of the turret when the turret is subject to rotational loading below a torque threshold and allows rotational movement of the turret when the turret is subject to rotational loading above the torque threshold. The controller dynamically adjusts the torque threshold in response to changes in the position of the boom during operation of the boom system, including applying a lower torque threshold when the boom is in a first position and applying a higher torque threshold when the boom is in a second position.

20 Claims, 7 Drawing Sheets

(56) References Cited

U.S. PATENT DOCUMENTS 5,272,877 A * 12/1993 Fukushima et al. ..... 60/327
5,292,220 A * 3/1994 Cartner ..... 414/687
5,332,110 A * 7/1994 Forsyth ..... 212/258
5,639,119 A * 6/1997 Plate et al. ..... 280/754
5,645,181 A * 7/1997 Ichiba et al. ..... 212/281
6,092,789 A * 7/2000 Christopher et al. ..... 254/274
6,496,766 B1 * 12/2002 Bernold ..... B66C 15/065 212/276
6,499,296 B1 * 12/2002 Weickert et al. ..... 60/466
6,735,486 B2 5/2004 Hoffelmeyer et al.
6,871,710 B1 3/2005 Darling et al.
6,945,336 B1 9/2005 Darling et al.
7,644,782 B1 * 1/2010 Coogan et al. ..... 173/1
2005/0189527 A1 * 9/2005 Young ..... 254/134.3 R
2005/0282678 A1 * 12/2005 Mundis ..... 475/269
2006/0090974 A1 * 5/2006 Pinto ..... E02F 3/301 188/381
2007/0012641 A1 * 1/2007 Hinata ..... B66C 23/80 212/277
2007/0246436 A1 * 10/2007 Picard et al. ..... 212/292
2010/0264106 A1 * 10/2010 Kawai et al. ..... 212/276

* cited by examiner

HYDRAULIC SIDE LOAD BRAKING SYSTEM

BACKGROUND

1. Field

The present invention relates to systems and methods for protecting against damage caused by undesired side loads on rotatable equipment, such as may be applied to the booms of mobile cranes and digger derricks. In particular, the present invention relates to a system and method for allowing a boom to slip in response to excessive side loading, wherein the boom slips at varying side load torque thresholds according to a position of the boom.

2. Related Art

Mobile cranes, digger derricks and other types of rotating equipment are commonly used to perform many different jobs, including lifting loads, digging holes for utility poles and installing screw anchors for supporting the poles. Mobile cranes and digger derricks are typically mounted to mobile utility vehicles and include a rotating turret from which a boom extends. The boom may be raised, lowered, extended, and retracted to position its outboard end in various locations to perform hoisting or digging operations. Digger and auger assemblies may be coupled with the outer end of the boom for digging holes for utility poles and for installing screw anchors.

Mobile cranes, digger derricks and other rotating equipment are often subjected to excessive and undesirable side loading. Side loading can be applied to a digger derrick boom when, for example, a winch attached to the boom is used to lift a load that is positioned to a side of the boom, or when the truck is positioned on a grade such that the boom is operated at a lateral inclination. Side loading also often occurs when an auger-type digger coupled with the boom "corkscrews" into the ground due to the application of excessive pressure in driving the auger or when anchors are improperly installed. Excessive side loading can cause damage or destruction of the rotation drive mechanism, the boom turret, and the boom.

Systems have been developed for protecting mobile cranes, digger derricks and other rotating equipment against excessive side loads. U.S. Pat. No. 4,100,973 owned by ALTEC INDUSTRIES, for example, discloses a side load protection system that attempts to sense undesired side load levels and respond with appropriate action when pre-established limits have been exceeded. The system uses relief valves that open when pressure increases beyond a desired level in a hydraulic motor to allow the boom driven by the motor to slip or rotate toward the external load, thereby reducing the side load. Other side load protection systems shut down certain digger derrick operations once side load limits have been reached.

Although generally effective, existing side load protection systems are subject to limitations. For example, such systems are configured to allow a particular maximum side load to be applied to the boom system regardless of the position of the boom. Because most booms can safely withstand different side loads in different positions, such side load protection systems often operate inefficiently, allowing the boom to slip when subject to lower side loads than is necessary.

SUMMARY

Embodiments of the present invention solve at least some of the above-described problems and provide a distinct advance in side load protection systems. A boom system in accordance with an embodiment of the invention comprises a boom turret, a brake and a controller. The brake prevents rotational movement of the boom turret when the turret is subject to rotational loading below a torque threshold and allows rotational movement of the turret when the turret is subject to rotational loading above the torque threshold. The controller actuates the brake to dynamically adjust the torque threshold in response to changes in the position of the boom during operation of the boom system, including applying a lower torque threshold when the boom is in a first position and applying a higher torque threshold when the boom is in a second position.

A method of operating a boom system in accordance with another embodiment of the invention comprises applying a brake to a boom turret to prevent rotational movement of the boom turret when the turret is subject to rotational loading below a torque threshold and to allow rotational movement of the turret when the turret is subject to rotational loading above the torque threshold. The method further comprises automatically adjusting the torque threshold in response to changes in the position of the boom during operation of the boom system, including applying a lower torque threshold when the boom is in a first position and applying a higher torque threshold when the boom is in a second position.

A boom system in accordance with yet another embodiment of the invention comprises a boom turret, a hydraulically actuated brake for preventing rotational movement of the boom turret, and a controller for actuating the brake. The brake is configured to prevent rotational movement of the boom turret when the turret is subject to rotational loading below a torque threshold and to allow rotational movement of the turret when the turret is subject to rotational loading above the torque threshold. The torque threshold is proportional to hydraulic pressure applied to the brake.

A hydraulic valve is in hydraulic communication with the brake and selectively applies hydraulic pressure to the brake in response to receiving control signals from a controller.

The controller dynamically communicates the control signals to the valve according to a position of the boom during operation of the boom system, including communicating signals resulting in less hydraulic pressure to the brake when the boom is in a position resulting in a smaller total weight radius and signals resulting in greater hydraulic pressure to the brake when the boom is in a position resulting in a larger total weight radius. The total weight radius comprises a boom weight radius and a load weight radius, the boom weight radius being the distance from a rotational axis of the turret to the center of gravity of the boom and the load weight radius being the distance from the rotational axis of the turret to a center of gravity of the load.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

Figure 1:
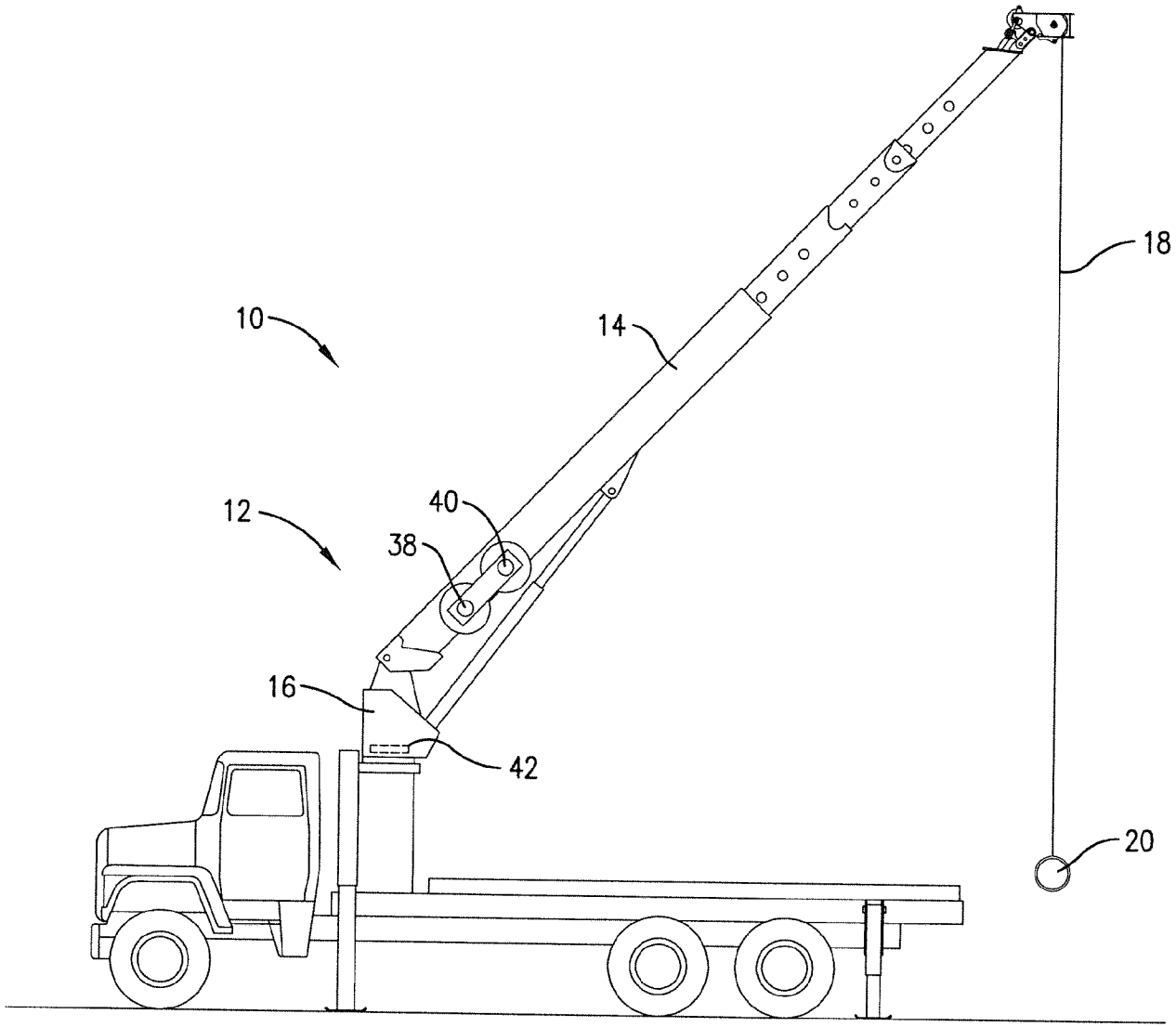
FIG. 1 is a side elevation view of a utility vehicle that may be equipped with embodiments of the invention described herein and that is shown lifting a load in-line with the boom, thereby resulting in no side loading of the boom.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawings, an exemplary utility vehicle 10 with a boom assembly 12 including a boom 14 and boom turret 16 constructed according to an exemplary embodiment of the present invention is illustrated. The boom assembly 12 is mounted on the vehicle 10 to enable rotational and/or pivotal movement of the boom 14 relative to a frame of the vehicle 10 and includes a loadline 18 for attaching to and lifting a load 20 in a conventional manner. The illustrated boom 14 comprises a plurality of nested boom sections that may be telescopically extended and retracted and a piston and cylinder assembly 22 for pivoting the boom 14 up and down relative to the vehicle 10. A spring-biased reel 44 holds a cable (not shown) that is connected to a distal end of the boom 14. The reel 44 is configured to wind and unwind the cable in response to extension and retraction of the boom 14. The vehicle 10 may further include additional implements or tools not depicted in the drawings, such as an auger attached to the boom for drilling a hole for utility pole placement.

The turret 16 and the boom 14 are rotatably driven by a hydraulic rotation motor 24 drivingly coupled to the turret 16 via a conventional drive linkage. A hydraulic brake device 26 is associated with the motor 24 and/or the turret 16 for selectively preventing the turret 16 from rotating. Both the motor 24 and the brake device 26 are described in greater detail below.

The boom assembly 12 is part of a boom system that is configured to prevent damage to the boom 14, turret 16 and other vehicle components from excessive side loading of the boom 14. The boom system is configured to dynamically adapt to changing side load protection requirements as the boom 14 assumes different positions during operation. In particular, the hydraulic brake device 26 is configured to allow the boom 14 to slip toward a side load when the side load torque exceeds a particular side load torque threshold, wherein the side load torque threshold varies with the position of the boom 14.

Figure 2:
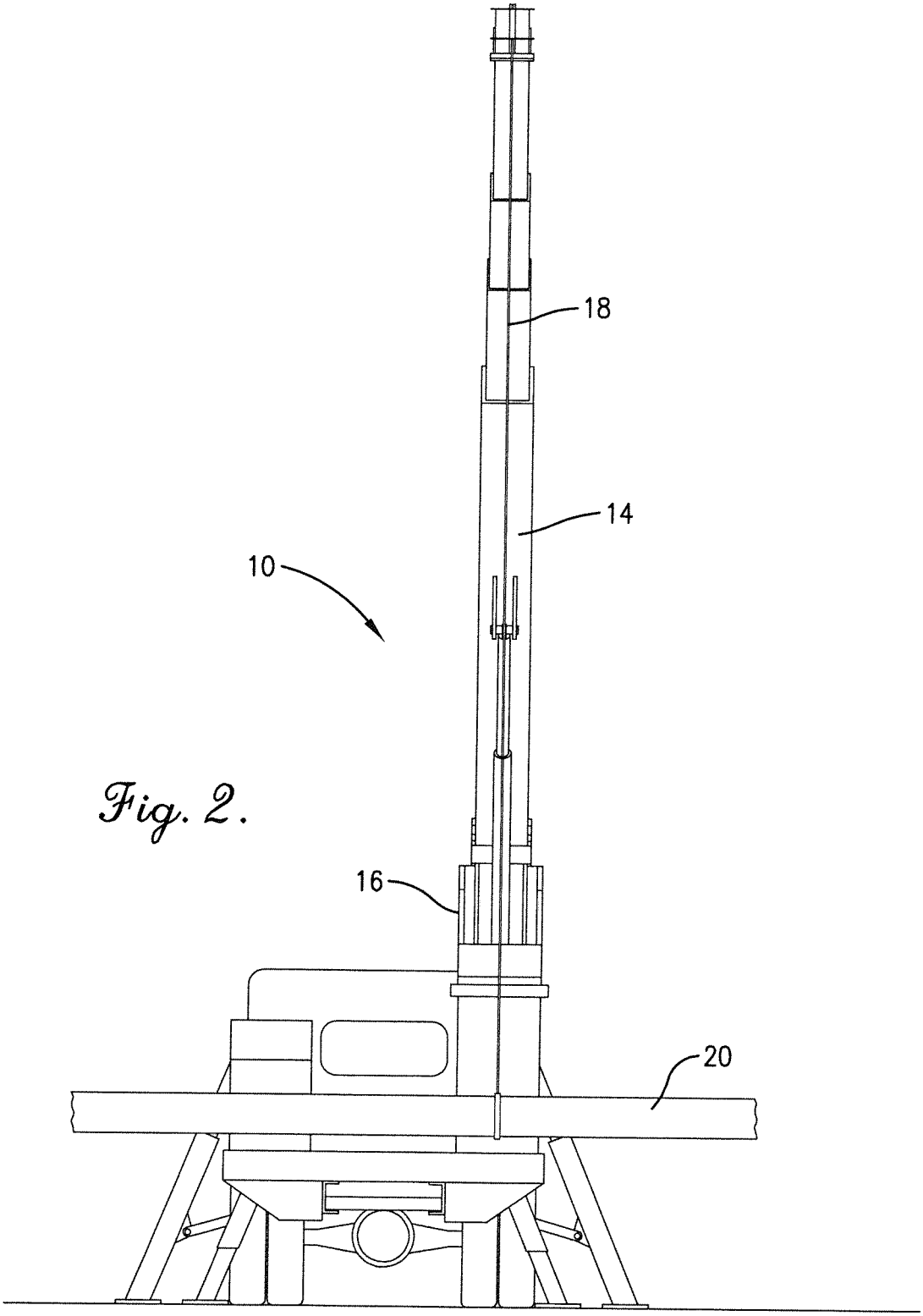
FIG. 2 is a rear elevation view of the utility vehicle of FIG. 1, illustrating the load in-line with the boom wherein a center of gravity of the load is positioned in lateral alignment with the boom.

As illustrated in FIGS. 1 and 2, the vehicle 10 may use the boom 14 to lift a load 20 such that the load 20 does not introduce a side load on the boom 14. The load 20 is positioned directly beneath, or in line with, the boom 14 such that the weight of the load 20 exerts purely downward pressure on the boom 14 and does not apply any lateral pressure on the boom 14. Thus, the load 20 does not tend to push the boom 14 toward one side or the other and does not induce rotational loading on the boom 14 or on the boom turret 16. As used herein, "rotational loading" means side load torque on the turret 16, or a force or pressure tending to induce rotational movement on the turret 16 due to side loading of the boom 14.

Figure 3:
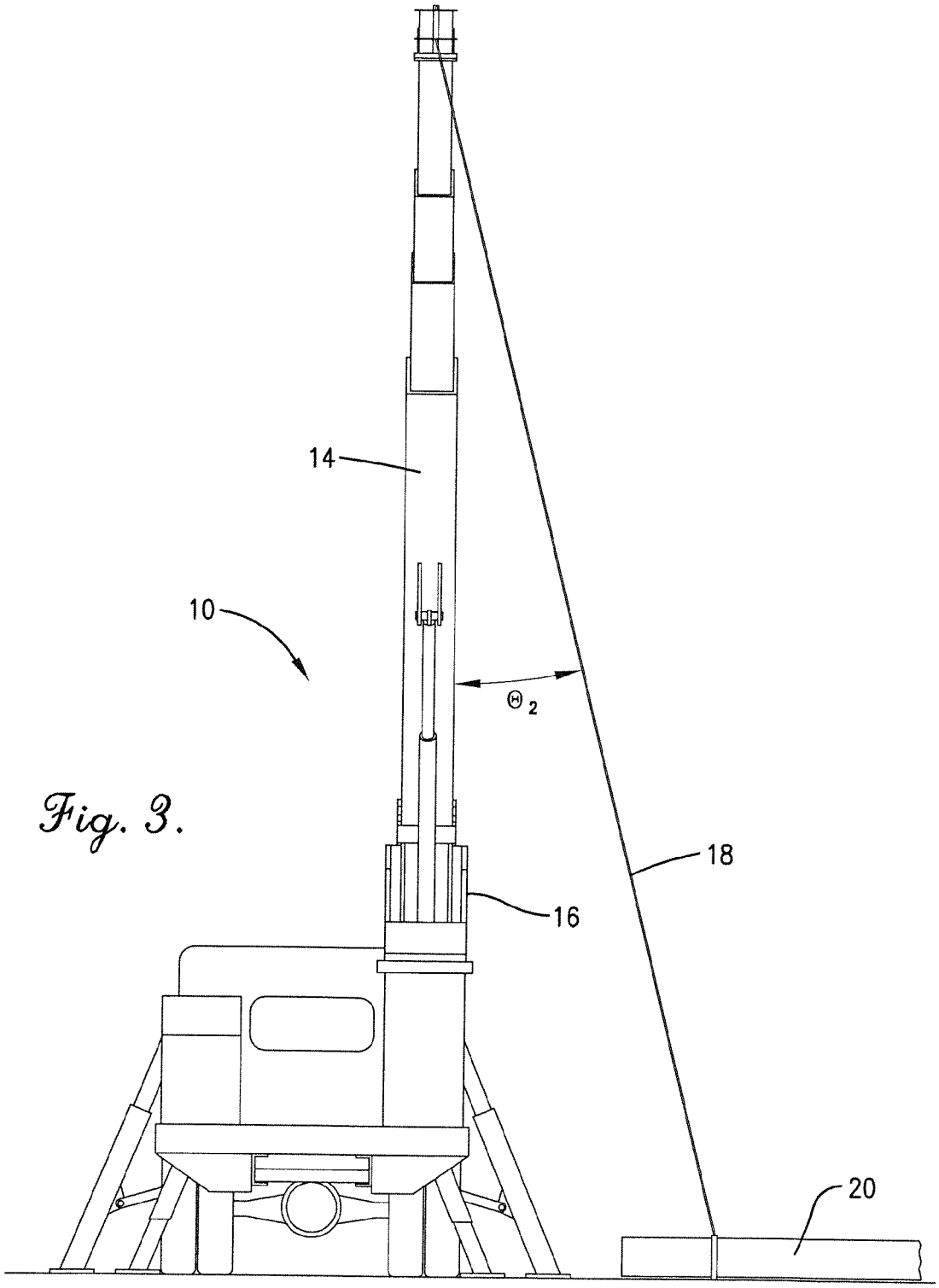
FIG. 3 is a rear elevation view of the utility vehicle of FIG. 1, shown lifting a load that is not laterally aligned with the boom and that creates a side load on the boom.
Figure 4:
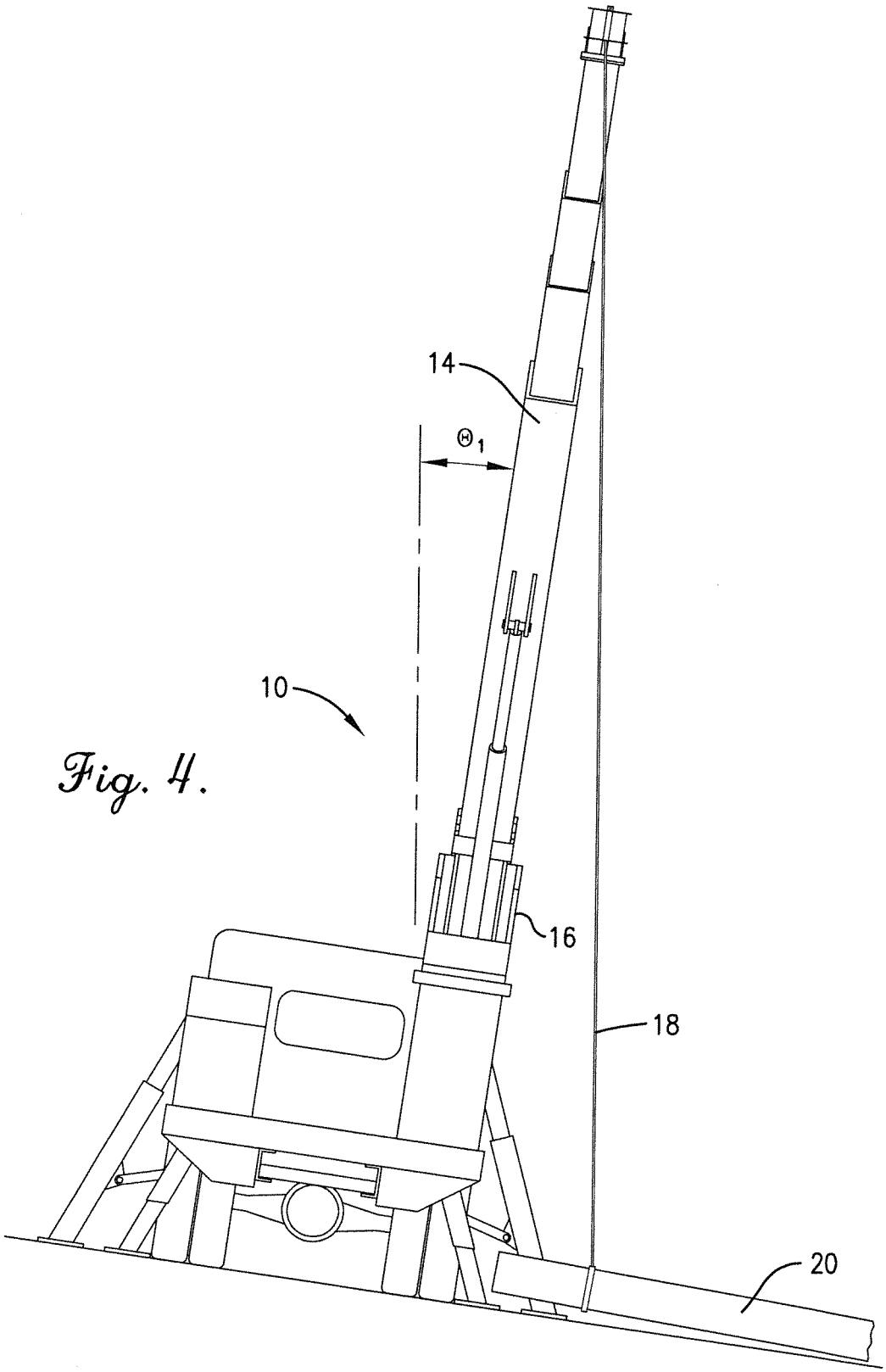
FIG. 4 is a rear elevation view of the utility vehicle of FIG. 1, shown positioned on a grade such that the boom is inclined from the horizontal and is lifting a load that results in a side load on the boom due to the inclination of the boom.

FIGS. 3 and 4 illustrate two exemplary scenarios in which the boom system may be side loaded. In FIG. 3, the vehicle 10 is lifting the load 20 from a position that is not in alignment with the boom 14 but is shifted laterally to one side of the boom 14. In this scenario, as the vehicle 10 winches the load 20 upward the boom 14 is urged in a lateral direction toward the load 20. In FIG. 4, the vehicle 10 is positioned on a slope such that the entire vehicle 10 is inclined laterally. In this scenario, the load 20 is positioned beneath the top of the boom 14, yet due to the lateral inclination of the boom 14 the weight of the load 20 induces a side load on the boom system, urging the boom 14 to shift laterally toward the load 20. Various other scenarios may result in side loading of the boom 14, as will be appreciated by those skilled in the art.

Figure 5:
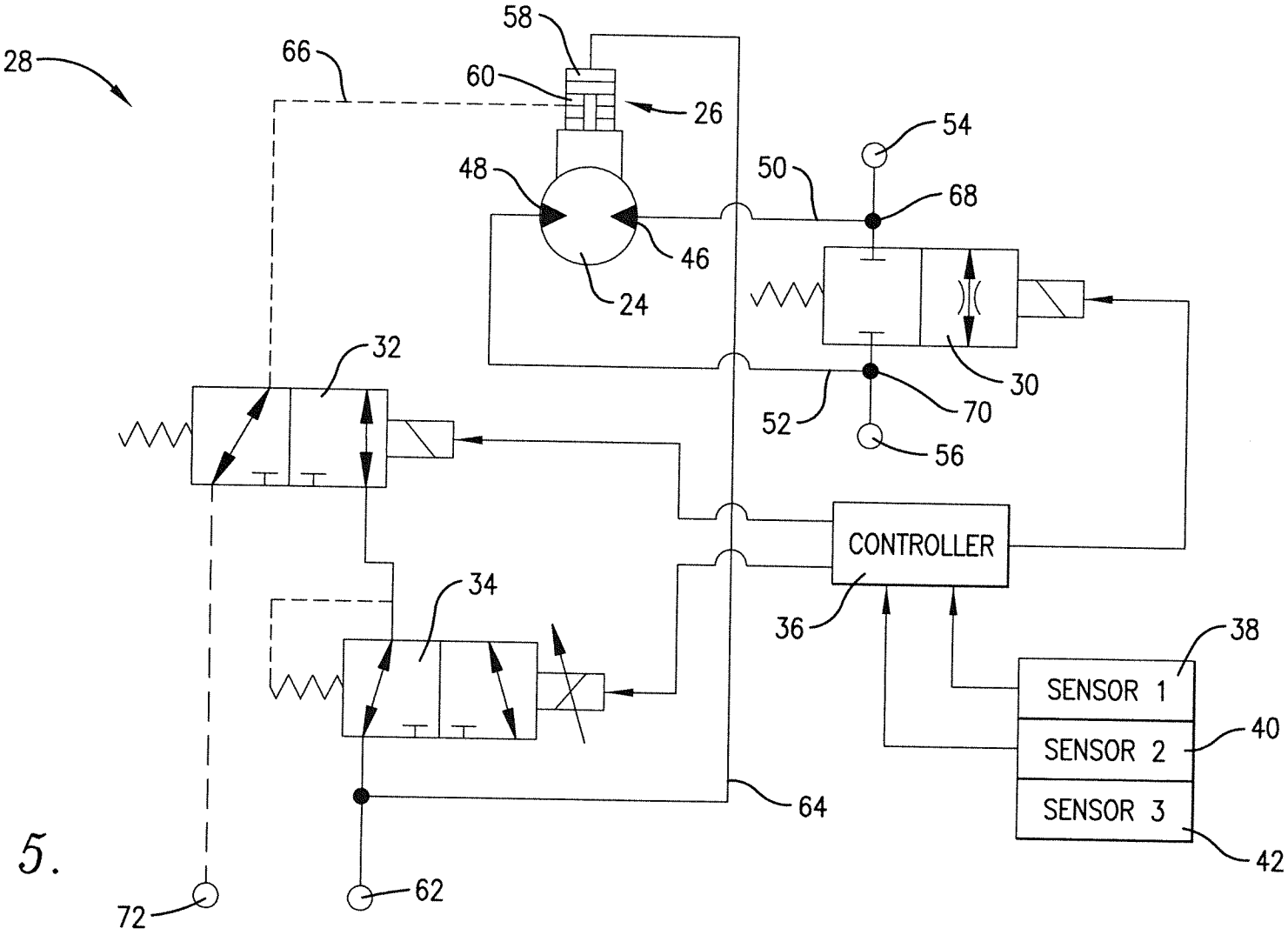
FIG. 5 is a schematic diagram of a first exemplary braking system constructed according to embodiments of the invention and used with the utility vehicle of FIG. 1, the braking system configured to prevent rotation of the boom at side loads below a torque threshold and further configured to adjust the torque threshold according to a position of the boom.

FIG. 5 illustrates schematically portions of an exemplary hydraulic system 28 which controls operation of the rotation motor 24 and the brake device 26. Components and circuits for operating other portions of the vehicle 10, including the systems for raising, lowering, extending and retracting the boom 14, may be conventional in nature and are omitted from the schematic of FIG. 5 for purposes of simplicity. The system 28 broadly includes the motor 24 and brake device 26, a first hydraulic valve 30 associated with the motor 24, second 32 and third 34 hydraulic valves associated with the brake device 26, a controller 36 for actuating the valves 30,32,34, and a plurality of sensors 38,40,42 in communication with the controller 36.

As illustrated, the rotation motor 24 includes a pair of first 46 and second 48 hydraulic ports for receiving and discharging a pressurized media such as hydraulic fluid or oil from conventional hydraulic lines 50,52 for driving the motor 24 in forward and/or reverse directions in a conventional manner. Operation of the motor 24 is controlled via a motor control system that is in hydraulic communication with the motor 24 via first and second hydraulic ports 54,56. The motor control system may be conventional in nature and is omitted from FIG. 5 for simplicity.

The brake device 26 includes both a parking brake 58 and a service brake 60. More particularly, the brake device 26 may be a multidisc brake assembly including a spring-biased, hydraulically-released parking brake that, when engaged, prevents the rotation motor 24 from being driven in either forward or reverse directions, thus preventing rotational movement of the turret 16 and the boom 14. The parking brake 58 is in hydraulic communication with a pressurized hydraulic source 62 via a hydraulic line 64. The service brake 60 is hydraulically actuated and applies rotation-resistant torque to the motor 24 proportional to hydraulic fluid pressure applied to the brake via a hydraulic line 66. The brake device 26 may be similar or identical to the brake described in U.S. Pat. No. 6,405,837, which is hereby incorporated by reference in its entirety.

The first hydraulic valve 30 is a solenoid valve with a first hydraulic port 68 and a second hydraulic port 70. The first hydraulic port 68 is in direct hydraulic communication with the first port 46 of the motor 24 and with the first port 54 of the hydraulic motor control system. The second hydraulic port 70 is in direct hydraulic communication with the second port 48 of the motor 24 and with the second port 56 of the hydraulic motor control system. When the valve 30 is in a first state (as shown), the first port 68 and the second port 70 are hydraulically isolated such that the ports 46,48 of the motor 24 are in hydraulic communication with only the motor control system via the ports 54,56, such that movement of the motor 24 is governed by operation of the motor control system. When the valve 30 is in a second state, the first and second ports 68,70 are hydraulically connected, effectively disengaging the motor 24 from the hydraulic motor control system and allowing the motor 24 (and the boom turret 16) to freely rotate.

The second hydraulic valve 32 is a three-way solenoid valve that alternately connects the service brake 60 of the brake device 26 to a hydraulic reservoir 72 or tank when in a first state, and to the third hydraulic valve 34 when in a second state. When the valve 32 is in the first state, the service brake 60 is hydraulically depressurized and released. When the valve 32 is in the second state, the service brake 60 is hydraulically pressurized via the third hydraulic valve 34.

The third hydraulic valve 34 receives fully pressurized hydraulic fluid from the pressurized hydraulic source 62 and provides variable hydraulic pressure to the second hydraulic valve 32. The third valve 34 may be an electrohydraulic proportional pressure reducing valve configured to regulate hydraulic pressure according to a control signal received from the controller 36.

Figure 7:
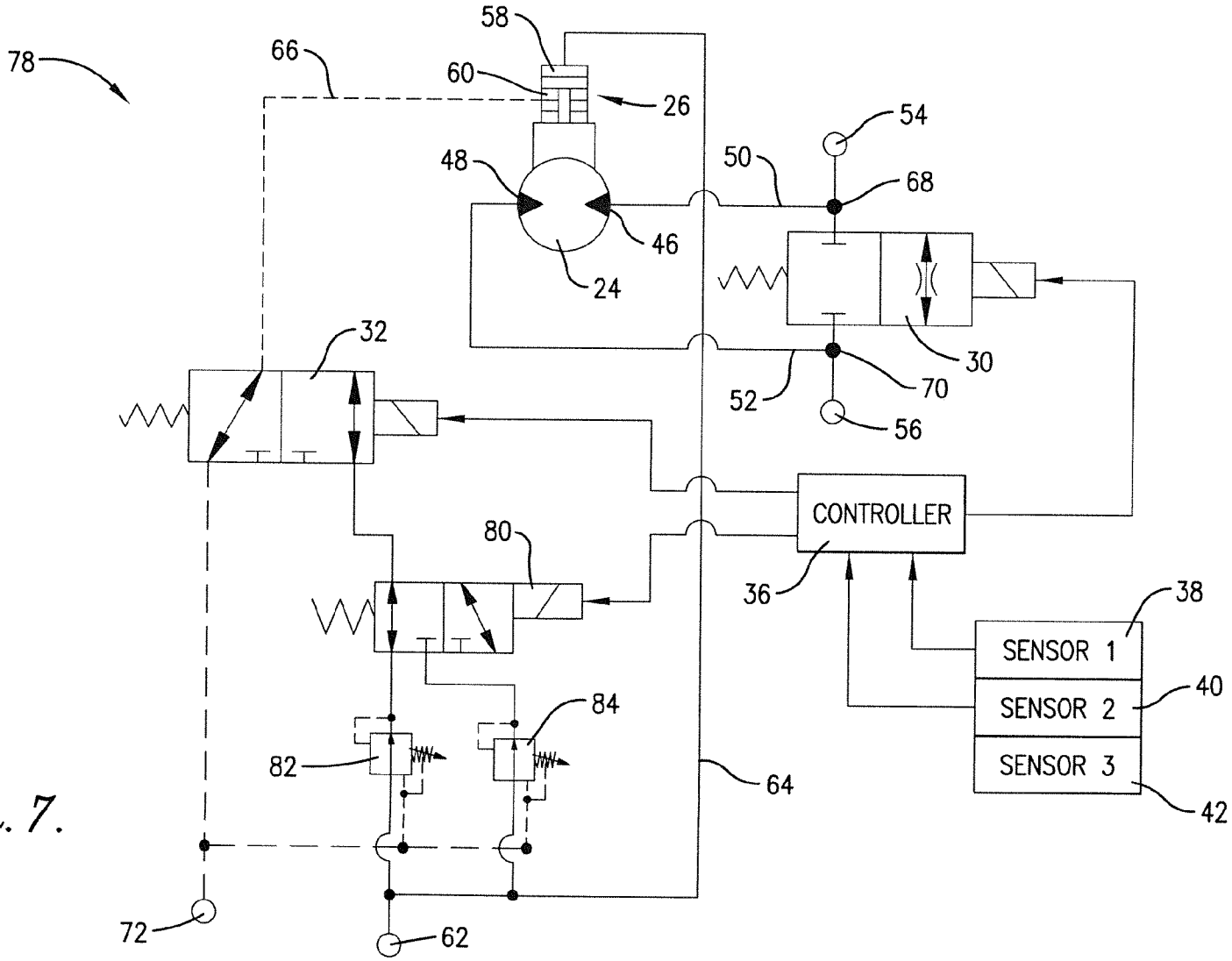
FIG. 7 is a schematic diagram of a second exemplary braking system constructed according to embodiments of the invention and used with the utility vehicle of FIG. 1, the braking system configured to prevent rotation of the boom at side loads below a torque threshold and further configured to adjust the torque threshold according to a position of the boom.

In the illustrated embodiment, the third hydraulic valve 34 provides a variable hydraulic pressure in response to control signals generated by the controller 36, wherein the output pressure of the valve 34 follows a continuous, smooth pattern or a substantially continuous, smooth pattern as it changes in response to changing input signals generated by the controller 36. Thus, the output pressure is analog in nature and can be set to virtually any pressure between a minimum pressure and a maximum pressure via the control signals generated by the controller 36. It will be appreciated by those skilled in the art that other configurations may be used without departing from the spirit or scope of the invention. The hydraulic valve 34 may be replaced, for example, with a valve or system of valves that generates a finite number of hydraulic pressure values according to a stepped pattern rather than a smooth pattern, as illustrated in FIG. 7 and described below.

Each of the plurality of sensors 38,40,42 detects a state of the boom 14 and communicates boom state information to the controller 36. For example, a first sensor 38 may sense a length of the boom 14, a second sensor 40 may sense an angle or elevation of the boom 14, and a third sensor 42 may detect a lateral angle of inclination of the boom 14. The controller 36 uses the sensed position information generated by the sensors 38,40,42 to adjust the threshold torque at which the boom turret 16 slips to protect the vehicle 10 from damage resulting from excessive side loading, as explained below in greater detail. By way of example, the first sensor 38 may be an inclinometer housed in or with the cable reel 44, and the second sensor 40 may be a multi-turn potentiometer coupled with the cable reel 44. As the boom 14 extends and retracts, the reel 44 rotates as it receives or feeds cable required to accommodate the changing length of the boom 14. The potentiometer tracks the rotation of the reel and, thus, the extension and retraction of the boom 14. The third sensor 42 may be a two-axis inclinometer positioned on a bearing plate of the turret 16 for detecting a lateral angle of inclination of the boom 14. It will be appreciated by those skilled in the art that the sensors 38,40,42 may be standalone components or, alternatively, may be part of a broader monitoring and protection system.

The controller 36 generally actuates the valves 30,32,34 in response to signals received from the sensors 38,40,42 to operate the hydraulic motor 24 and the brake device 26 as described herein. The controller 36 is preferably a digital integrated circuit and may be a general use, commercial off-the-shelf computer processor programmed to perform the functions described herein. Alternatively, the controller 36 may be a programmable logic device configured for operation with the hydraulic system 28, or may be an application specific integrated circuit (ASIC) especially manufactured for use in the system 28. While illustrated as a single component in the schematic diagram, the controller 36 may include two or more separate integrated circuits working in cooperation to control operation of the system 28, and may include one or more analog elements operating in concert with or in addition to the digital circuit or circuits. The controller 36 may include a memory element to store data, instructions, or both used by the controller.

The hydraulic system 28 generally operates in three phases: disabled, enabled not rotating, and enabled rotating. When the system 28 is disabled, all hydraulic lines are generally depressurized including the lines feeding the parking brake 58 and the service brake 60. Depressurizing the hydraulic line 66 feeding the service brake 60 causes the brake 60 to release. Depressurizing the hydraulic line 64 feeding the parking brake causes the parking brake 58 to engage and remain engaged until the system 28 is enabled and the hydraulic lines are pressurized, thus preventing rotational movement of the boom turret 16 while the system 28 is shut down.

When the system 28 is enabled, the hydraulic source 62 is pressurized, pressurizing the hydraulic line 64 feeding the parking brake 58 and causing the parking brake 58 to release. During operation the boom turret 16 may be in motion (rotating) or may be stationary. When the boom turret 16 is rotating, the controller 36 actuates the first valve 30 to connect the motor 24 to the motor hydraulic control system and actuates the second valve 32 to depressurize the service brake line 66, thereby releasing the service brake 60. In this state, both the service 60 and parking 58 brakes are released and the turret 16 rotates according to the motion induced by the motor 24.

When the system 28 is enabled and the boom turret 16 is not rotating, the parking brake 58 is released, as explained above, and the controller 36 actuates the first valve 30 to disengage the motor 24 from the hydraulic motor control system, thus allowing the motor 24 and turret 16 to freely rotate except as impeded by the service brake 60. The controller 36 actuates the second valve 32 to connect the service brake 60 to the third valve 34, and actuates the third valve 34 to selectively apply a hydraulic pressure to the service brake 60 according to the position of the boom 14 as detected by the sensors 38,40,42.

The service brake 60 is configured to prevent rotational movement of the boom turret 16 when the turret 16 is subject to torque below a torque threshold and to allow rotational movement of the turret 16 when the turret 16 is subject to torque above the torque threshold. The torque threshold is adjustable according to the hydraulic pressure applied to the service brake 60 via the third valve 34, wherein increasing the hydraulic pressure causes the torque threshold to increase. Therefore, the controller 36 regulates the torque threshold by controlling the third valve 34 to adjust the hydraulic pressure communicated to the service brake 60.

The controller 36 may be configured to actuate the third valve 34 such that the torque threshold is related to a measured or estimated side load torque induced on the boom turret 16 by the side load on the boom 14. The torque threshold, for example, may be directly proportional to the measured or estimated side load torque on the boom turret 16.

The total side load torque on the boom turret 16 is affected by various factors, including the lateral position of the load 20 relative to the boom 14, the weight of the boom 14, the weight of the load 20, the length of the boom 14, and the angle of the boom 14 relative to the vehicle 10. When the vehicle 10 is operating in an inclined position as illustrated in FIG. 4, for example, the side load torque on the turret 16 comprises the torque resulting from the weight of the boom 14 plus the torque resulting from the weight of the load 20, according to the following equations:

$$T_{axis}=(B_t\times B_{wr})+(L_t\times L_{wr})$$

$$B_t=B_w\times \mathrm{Sin}(\theta_1)$$

$$L_t=L_w\times \mathrm{Sin}(\theta_2)$$

where $T_{axis}$ is the total side load torque at the boom's axis of rotation, $B_{wr}$ is the boom weight radius (FIG. 6), $L_{wr}$ is the load weight radius (FIG. 6), $B_w$ is the weight of the boom, $L_w$ is the weight of the load, $\theta_1$ is the lateral angle of inclination of the boom, and $\theta_2$ is the angle of separation of the load line from the boom.

Figure 6:
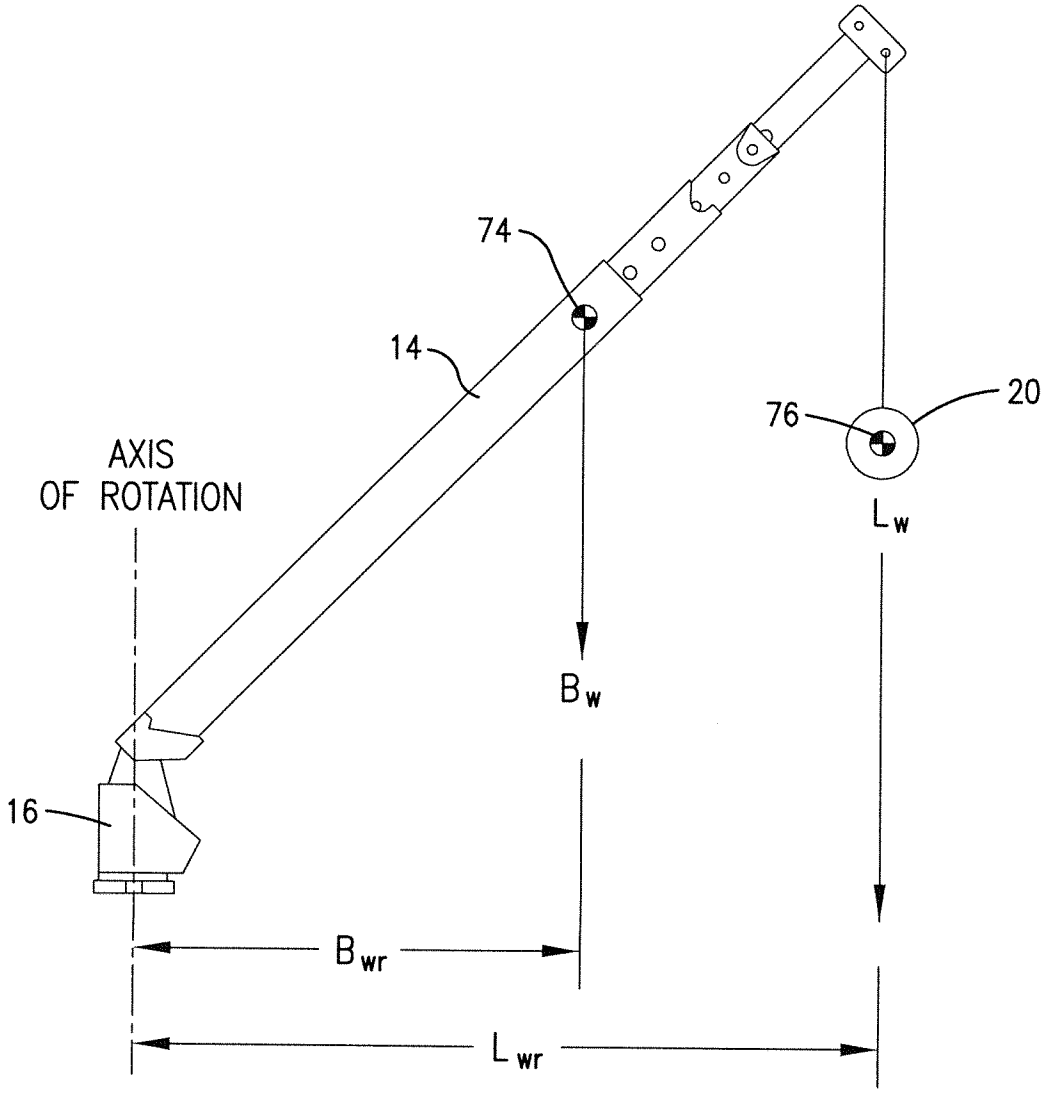
FIG. 6 is a diagram of the boom illustrating a boom weight radius and a load radius of the boom used by the system of FIG. 5 to determine the torque threshold.

FIG. 6 includes a diagram illustrating how the boom weight radius and the load weight radius are measured. The boom weight radius is the distance between the axis of rotation of the boom 14 and the boom's center of gravity 74. The load weight radius is the distance between the axis of rotation of the boom 14 and the center of gravity 76 of the load 20. Together, the boom weight radius and the load weight radius comprise a total weight radius. As can be seen from FIG. 6, either extending the boom or lowering the boom causes the total weight radius to increase. Similarly, either retracting the boom or raising the boom causes the total weight radius to decrease.

To facilitate calculating the total side load torque on the turret 16, various assumptions may be made regarding the variables in the equations set forth above. In particular, it may be assumed, for example, that the vehicle 10 is always operating on a particular lateral angle of inclination, such as an angle within the range of 0° to 15°, and that the load 20 is always directly beneath the end of the boom 14, such that both $\theta_1$ and $\theta_2$ are equal to the lateral angle of inclination of the vehicle 10. Furthermore, the boom weight will typically be a known amount and the load weight may be either a known amount (for example, if the load is a drilling tool) or may be assumed to be a maximum amount. In this scenario, the boom weight radius and the load radius are the only variables and may be determined from the length and angle of the boom using the sensors 38,40,42. Furthermore, $\theta_1$, $\theta_2$, or both may be measured automatically using one or more of the sensors 38,40,42.

By way of example, the torque threshold may be approximately equal to the side load torque on the turret 16 as calculated using the equations set forth above with particular values assigned to the variables $L_w$, $\theta_1$ and $\theta_2$ according to the limitations of the particular system. Depending on the structure of the boom assembly 12 and the functionality of the service brake 56, additional calculations or adjustments to the total side load torque as calculated may be required to determine the proper hydraulic pressure to be applied to the service brake 60 to ensure the brake 60 is operating at the desired torque threshold. The total side load torque associated with the boom's axis of rotation, as calculated using the above equations, may be adjusted to reflect a gear ratio associated with drive gears between the boom turret 16 and the motor 24. Such modifications will vary from one implementation to another.

FIG. 7 illustrates schematically portions of a second exemplary hydraulic system 78 for controlling operation of the rotation motor 24 and the brake device 26. The system 78 is identical to the system 28, described above, except that the third hydraulic valve 34 is replaced by a second three-way solenoid valve 80 and first 82 and second 84 static pressure reducing hydraulic valves. The three-way valve 80 is actuated by control signals from the controller 36 and alternately connects the first static pressure reducing valve 82 and the second static pressure reducing valve 84 to the second valve 32.

The first static pressure reducing valve 82 receives pressurized hydraulic fluid from the source 62 and communicates pressurized hydraulic fluid to a first input of the three-way valve 80 at a first reduced pressure. The second static pressure reducing valve 82 also receives pressurized hydraulic fluid from the source 62 and communicates pressurized hydraulic fluid to a second input of the three-way valve 80 at a second reduced pressure. The first reduced pressure is different than the second reduced pressure such that either the first reduced pressure or the second reduced pressure is communicated to the service brake 60 via the second hydraulic valve 32 and the three-way valve 80 depending on the state of the three-way valve 80. While the system 78 is illustrated and described with two static pressure reducing valves 82 and 84, it will be appreciated by those skilled in the art that three or more static pressure reducing valves may be used.

Although the invention has been described with reference to the exemplary embodiments illustrated in the attached drawings, it is noted that equivalents may be employed and substitutions made herein without departing from the scope of the invention as recited in the claims. For example, while the motor 24 and brake device 36 have been illustrated and described herein as being hydraulically actuated, it will be appreciated by those skilled in the art that such components may be actuated via electromechanical or other means.

Having thus described various embodiments of the invention, what is claimed as new and desired to be protected by Letters Patent includes the following:

1. A boom system for supporting a load comprising:

a boom configured to pivot upward and downward in a pivoting plane, said boom configured to su ort the load in either an aligned orientation or a non-aligned orientation, wherein the aligned orientation is defined as the load being directly below the boom in the pivoting plane, wherein the non-aligned orientation is defined as the load being outside the pivoting plane, such that the load imparts a torque on the boom;

a boom turret configured to selectively rotate the boom safely while the torque imparted on the boom is below a torque safety threshold;

a brake for preventing rotational movement of the boom turret, wherein when the torque imparted on the boom is turret is below the torque safety threshold, the brake prevents rotational movement of the boom turret, wherein when the torque imparted on the boom is above the torque safety threshold, the brake allows rotational movement of the boom turret; and a controller for automatically actuating the brake to dynamically adjust the torque safety threshold in response to changes in the position of the boom during operation of the boom system, wherein the controller applies a lower torque safety threshold when the boom is in a first position, wherein the controller applies a higher torque safety threshold when the boom is in a second position, wherein the brake is configured to allow rotational movement when the torque is above the torque safety threshold such that damage to the boom system is prevented.

2. The boom system of claim 1, the first position resulting in a smaller total-weight radius and the second position resulting in a larger total-weight radius, wherein the total-weight radius is a distance measurement being the summation of a boom-weight radius and a load-weight radius, wherein the boom-weight radius is the horizontal distance from a central, vertical rotational axis of the turret to the center of gravity of the boom, wherein the load-weight radius is the horizontal distance from said central, vertical rotational axis of the turret to a center of gravity of the load.

3. The boom system of claim 1, further comprising a motor for inducing rotational movement in the boom turret, wherein the controller disengages the motor from the boom turret when applying the brake, wherein the controller disengages the brake from the turret when activating the motor to rotate the boom turret.

4. The boom system of claim 1, further comprising a first sensor for sensing a length of the boom and a second sensor for sensing an angle of the boom, the first sensor and the second sensor in communication with the controller for communicating boom length and angle information to the controller.

5. The boom system of claim 1, wherein the controller actuates the brake such that the torque safety threshold increases and decreases according to a continuous, smooth pattern.

6. The boom system of claim 1, wherein the controller actuates the brake such that the torque safety threshold increases and decreases according to a stepped pattern comprising a plurality of discreet torque safety threshold values.

7. A boom system comprising:

a boom configured to pivot upwards and downwards in a pivoting plane and to support a load;

a boom turret configured to rotate the boom;

a hydraulically actuated brake configured to prevent rotational movement of the boom turret when the boom is subject to a loading outside the pivoting plane so as to impart a torque on the boom turret below a torque safety threshold and to allow rotational movement of the boom turret when said torque exceeds the torque safety threshold so as to prevent damage to the boom system;

a hydraulic valve in hydraulic communication with the brake, the hydraulic valve for selectively applying hydraulic pressure to the brake in response to receiving control signals, wherein the hydraulic pressure applied by the hydraulic valve is associated with and proportional to the torque safety threshold; and a controller for dynamically communicating the control signals to the valve according to a position of the boom during operation of the boom system, wherein the control signals result in less hydraulic pressure to the brake when the boom is in a position resulting in a smaller total-weight radius, wherein the control signals result in greater hydraulic pressure to the brake when the boom is in a position resulting in a larger total-weight radius, wherein the total-weight radius is a distance measurement being the summation of a boom-weight radius and a load-weight radius, wherein the boom-weight radius is the horizontal distance from a central, vertical rotational axis of the turret to the center of gravity of the boom, wherein the load-weight radius is the horizontal distance from said central, vertical rotational axis of the turret to a center of gravity of the load.

8. The boom system of claim 7, further comprising a hydraulic motor for inducing rotational movement in the boom turret, wherein the controller disengages the motor from the turret when applying the brake.

9. The boom system of claim 8, the controller being configure to disengage the brake from the turret when activating the motor to rotate the turret.

10. A boom system for supporting a load, the boom system comprising:

a boom turret configured to rotate a boom;

a hydraulically actuated brake configured to selectively prevent rotational movement of the boom turret;

a hydraulic valve in hydraulic communication with the brake, the valve for selectively applying hydraulic pressure to the brake in response to control signals;

a plurality of sensors for detecting a position of the boom associated with the boom turret during operation of the boom system; and a controller for ensuring that the brake prevents unsafe operation of the boom assembly, said controller receiving information indicative of the position of the boom during operation of the boom system, said controller determining a torque safety threshold based upon a total weight radius of the boom assembly, wherein the torque safety threshold is a calculation of the maximum torque under which the boom turret can safely rotate, wherein the torque is imparted on the boom turret from the load being disposed outside a pivoting plane of the boom, said controller dynamically communicating the control signals to the valve based upon the torque safety threshold.

11. The boom system of claim 10, wherein the control signal results in less hydraulic pressure to the brake when the boom is in a position resulting in a smaller total-weight radius, wherein the control signal results in greater hydraulic pressure to the brake when the boom is in a position resulting in a larger total-weight radius.

12. The boom system of claim 11, wherein the total-weight radius is a distance measurement being the summation of a boom-weight radius and a load-weight radius, wherein the boom-weight radius is a horizontal distance from a central, vertical rotational axis of the turret to the center of gravity of the boom, wherein the load-weight radius is a horizontal distance from said central, vertical rotational axis of the turret to a center of gravity of the load.

13. The boom system of claim 10, further comprising a motor for inducing rotational movement in the boom turret, wherein the controller disengages the motor from the boom turret when applying the brake, wherein the controller disengages the brake from the boom turret when activating the motor to rotate the boom turret.

14. The boom system of claim 10, further comprising a first sensor for sensing a length of the boom and a second sensor for sensing an angle of the boom, the first sensor and the second sensor in communication with the controller for communicating boom length and angle information to the controller.

15. The boom system of claim 1, wherein the load is outside the pivoting plane of the boom because load is at least partially in contact with the ground and located in a position other than directly below the boom, such that lifting the load imparts a rotational torque on the boom and the boom turret.

16. The boom system of claim 1, wherein the load is outside the pivoting plane of the boom because the boom system is not level due to a utility vehicle to which the boom system is secured being located on a non-level surface, such that lifting the load imparts a rotational torque on the boom and the boom turret.

17. The boom system of claim 7, wherein the load is outside the pivoting plane of the boom because load is at least partially in contact with the ground and located in a position other than directly below the boom, such that lifting the load imparts a rotational torque on the boom and the boom turret.

18. The boom system of claim 7, wherein the load is outside the pivoting plane of the boom because the boom system is not level due to a utility vehicle to which the boom system is secured being located on a non-level surface, such that lifting the load imparts a rotational torque on the boom and the boom turret.

19. The boom system of claim 10, wherein the load is outside the pivoting plane of the boom because load is at least partially in contact with the ground and located in a position other than directly below the boom, such that lifting the load imparts a rotational torque on the boom and the boom turret.

20. The boom system of claim 10, wherein the load is outside the pivoting plane of the boom because the boom system is not level due to a utility vehicle to which the boom system is secured being located on a non-level surface, such that lifting the load imparts a rotational torque on the boom and the boom turret.

* * * * *